US007448090B2

(12) United States Patent
Lucock

(10) Patent No.: US 7,448,090 B2
(45) Date of Patent: Nov. 11, 2008

(54) NURSING GARMENT

(75) Inventor: Tracey Lucock, Manly (AU)

(73) Assignee: Fresh Ideas (Australia) Pty Ltd, Manly (AU)

( * ) Notice: Subject to any disclaimer, the term of this patent is extended or adjusted under 35 U.S.C. 154(b) by 0 days.

(21) Appl. No.: 11/572,089

(22) PCT Filed: Jul. 7, 2005

(86) PCT No.: PCT/AU2005/001043

§ 371 (c)(1),
(2), (4) Date: Jan. 12, 2007

(87) PCT Pub. No.: WO2006/007636

PCT Pub. Date: Jan. 26, 2006

(65) Prior Publication Data

US 2008/0000004 A1 Jan. 3, 2008

(30) Foreign Application Priority Data

Jul. 22, 2004 (AU) ..... 2004100586

(51) Int. Cl.
*A41D 1/20* (2006.01)
*A41C 3/04* (2006.01)

(52) U.S. Cl. ..... 2/104; 450/36; 450/37

(58) Field of Classification Search ..... 2/104, 2/267, 106, 107, 109, 110, 112, 102, 113, 2/114, 70; 450/6, 36, 3, 28, 30–32, 37, 54, 450/55, 57, 60, 14; 604/387, 388, 393, 385.07; 128/890
See application file for complete search history.

(56) References Cited

U.S. PATENT DOCUMENTS

| | | | | | |
|---|---|---|---|---|---|
| 1,095,109 | A | * | 4/1914 | Harrington | 450/55 |
| 1,766,272 | A | * | 6/1930 | Vallier | 2/114 |
| 2,019,996 | A | * | 11/1935 | Roth | 450/14 |
| 2,274,382 | A | * | 2/1942 | Richman | 2/70 |
| 2,585,338 | A | * | 2/1952 | Meares | 450/36 |

(Continued)

FOREIGN PATENT DOCUMENTS

BE 878308 * 12/1979

(Continued)

*Primary Examiner*—Amy B Vanatta
(74) *Attorney, Agent, or Firm*—Kirton & McConkie; Evan R. Witt

(57) ABSTRACT

A nursing garment in which the front panel is divided into upper and lower sections whereby the upper section is overlaps and is attached to the lower section via a detachable seam extending horizontally across the front of the garment below the breast. Optionally nursing pads are placed into annular pockets.

10 Claims, 4 Drawing Sheets

U.S. PATENT DOCUMENTS

| | | | | | |
|---|---|---|---|---|---|
| 3,185,156 | A | * | 5/1965 | Steinberger | 450/14 |
| 3,203,424 | A | * | 8/1965 | Garutso | 450/68 |
| 3,327,714 | A | * | 6/1967 | Steinberger | 450/14 |
| 3,425,420 | A | * | 2/1969 | Steinberger | 450/36 |
| 3,701,168 | A | * | 10/1972 | Balow | 450/54 |
| 4,031,566 | A | * | 6/1977 | Johnson | 2/104 |
| 4,144,593 | A | * | 3/1979 | Timmons | 2/104 |
| 4,528,699 | A | | 7/1985 | Hughes | |
| 4,663,782 | A | | 5/1987 | Knox et al. | |
| 4,911,677 | A | * | 3/1990 | White | 450/36 |
| 5,103,501 | A | * | 4/1992 | Meisels | 2/113 |
| 5,331,685 | A | * | 7/1994 | Belgard | 2/79 |
| 5,611,086 | A | * | 3/1997 | Eggen | 2/104 |
| D382,687 | S | * | 8/1997 | Schaffner | D2/703 |
| 6,074,273 | A | * | 6/2000 | Turner et al. | 450/37 |
| 6,659,841 | B2 | * | 12/2003 | Raimondo | 450/36 |
| 6,983,489 | B2 | * | 1/2006 | Caprio | 2/106 |
| 2003/0031976 | A1 | * | 2/2003 | Clark | 433/19 |
| 2004/0143885 | A1 | * | 7/2004 | Rothman | 2/104 |
| 2006/0031976 | A1 | * | 2/2006 | Nwawka | 2/114 |
| 2007/0105481 | A1 | * | 5/2007 | Scholz | 450/3 |
| 2007/0249263 | A1 | * | 10/2007 | Itzhak | 450/32 |

FOREIGN PATENT DOCUMENTS

| | | | |
|---|---|---|---|
| DE | 19800972 | A1 | 7/1999 |
| EP | 1127499 | A2 | 8/2001 |
| FR | 2670993 | A1 | 7/1992 |
| GB | 2246947 | A | 2/1992 |

* cited by examiner

NURSING GARMENT

FIELD OF THE INVENTION

This invention relates to tank tops and similar garments worn by nursing mothers to facilitate the breast feeding of babies.

BACKGROUND OF THE INVENTION

One of the most stressful challenges facing new mothers is breast feeding their baby. Many new mothers are reluctant to go out in public for fear their baby will need to be fed and that they will not be able to do this in comfort and without embarrassing themselves or others.

Breastfeeding a new baby in public can be a daunting task for a new mother for a number of reasons. Many restaurant, business and shopping precincts do not provide any area for breastfeeding other than the rest room. Where facilities are provided the mother is then separated from friends and family for the duration of the feeding period. Even in the privacy of the homes of friends and families, new mothers are often self conscious about exposing their breast or stomach depending on the way they choose to breastfeed.

While Australian law stipulates that mothers can breastfeed in public, and some experienced mothers are able to do this discreetly, most new mothers share the same problems and fears in relation to breastfeeding. Specifically ordinary tops must either be lifted from the bottom exposing post-partum stomachs or dropped from the top exposing enlarged breasts. Nursing bras are cumbersome and difficult to open and close under normal clothes.

Existing breast feeding garments either look like nursing bras in their general design or are large cumbersome coveralls or capes that draw even more attention to the fact that the mother is breastfeeding. Also, vests and tank tops worn as external garments or worn beneath conventional garments, are not long enough to cover a post-partum stomach and do not provide the support required for enlarged breasts, nor to hold breast pads in place. They are often not of a fabric quality suitable for hiding breast pads and usually draw attention to the fact that the mother is breastfeeding.

OBJECT OF THE INVENTION

It is therefore an object of the present invention to ameliorate some of the disadvantages and limitations of traditional prior art nursing garments by providing a top which is easy to open and close and allows the mother to breast feed her baby discretely and in comfort.

STATEMENT OF THE INVENTION

According to one but not necessarily the only aspect, the invention resides in a garment top in which the front panel is divided into an upper section and a lower section with the upper attached to the lower section in a detachable seam extending across the front of the garment just below the breasts.

Preferably, the upper section of the garment is attached to the lower section by fixing means which include press studs, VELCRO® hook and loop fasteners, hooks and eyes, magnetic strips, zips, buttons and slide fasteners.

Preferably, the garment incorporates circular pockets on the inside of the upper section adjacent to the breast nipples, which pockets are adapted to receive nursing pads.

Preferably, the lower section of the garment provides ample space to accommodate the enlarged stomach of a mother before and after birth.

Alternatively, the upper section of the garment is designed in a crossover style, which nicely accommodates enlarged breasts.

Alternatively, the upper section of the garment is designed in a V neck style.

Alternatively, the upper section of the garment has long sleeves.

DETAILED DESCRIPTION OF THE INVENTION

Figure 1:
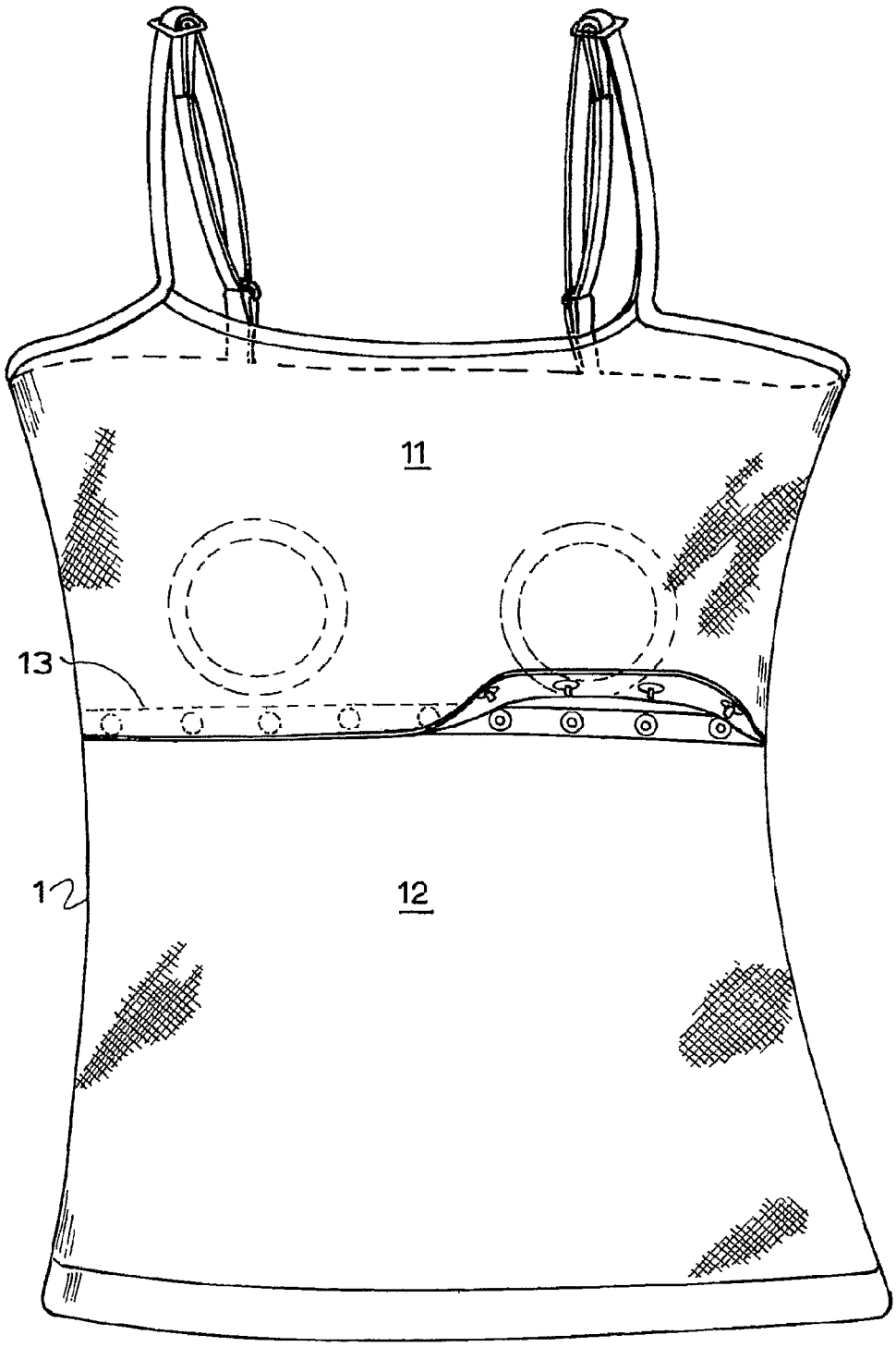
FIG. 1 is a front view of a nursing top according to the present invention.

In FIG. 1 a tank top 1 of conventional appearance is shown. However it has been modified in accordance with the present invention by providing an upper section 11 which is detachable below the breasts from the lower section 12. A horizontal seam 13 of press studs is provided for attachment of the two sections for normal wearing.

Figure 4:
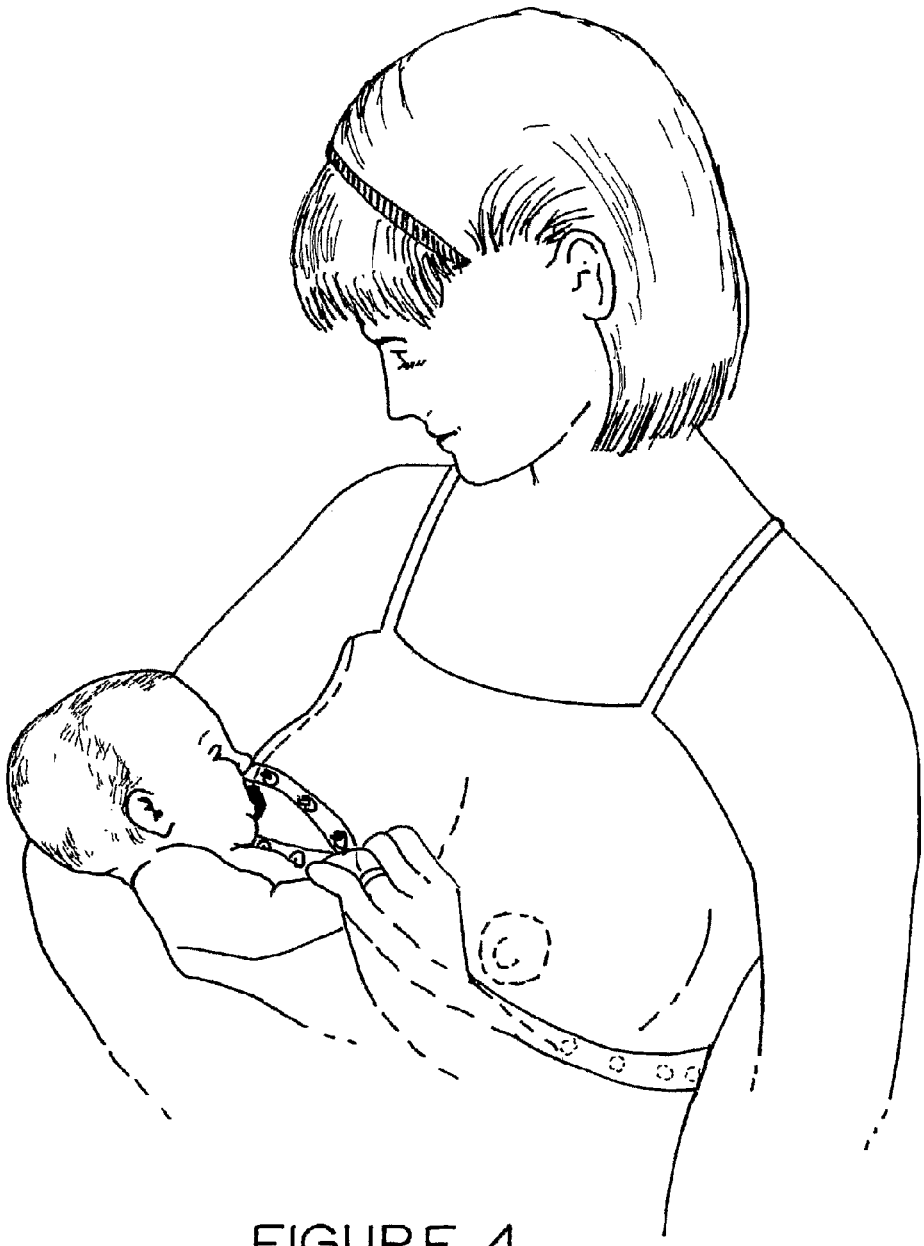
FIG. 4 shows the mother wearing the top of FIG. 1, feeding her baby.

When the mother wishes to feed her baby she unclips the press studs 13 below the feeding breast which allows the baby to access the nipple. It will be apparent that this results in minimal exposure of the breast since the babies head tends to cover the limited opening provided in the garment as illustrated in FIG. 4.

Figure 2:
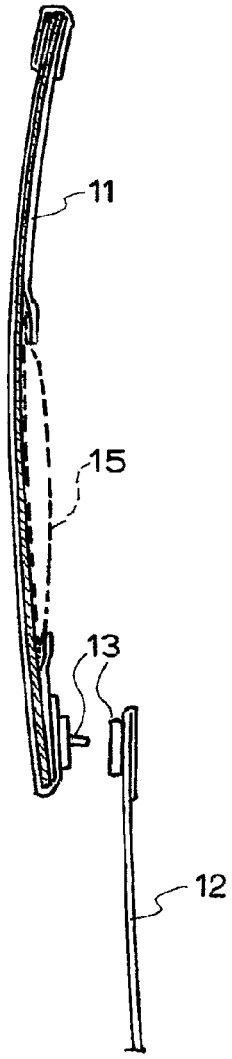
FIG. 2 is a cross-sectional view through the line AA shown in FIG. 3.
Figure 3:
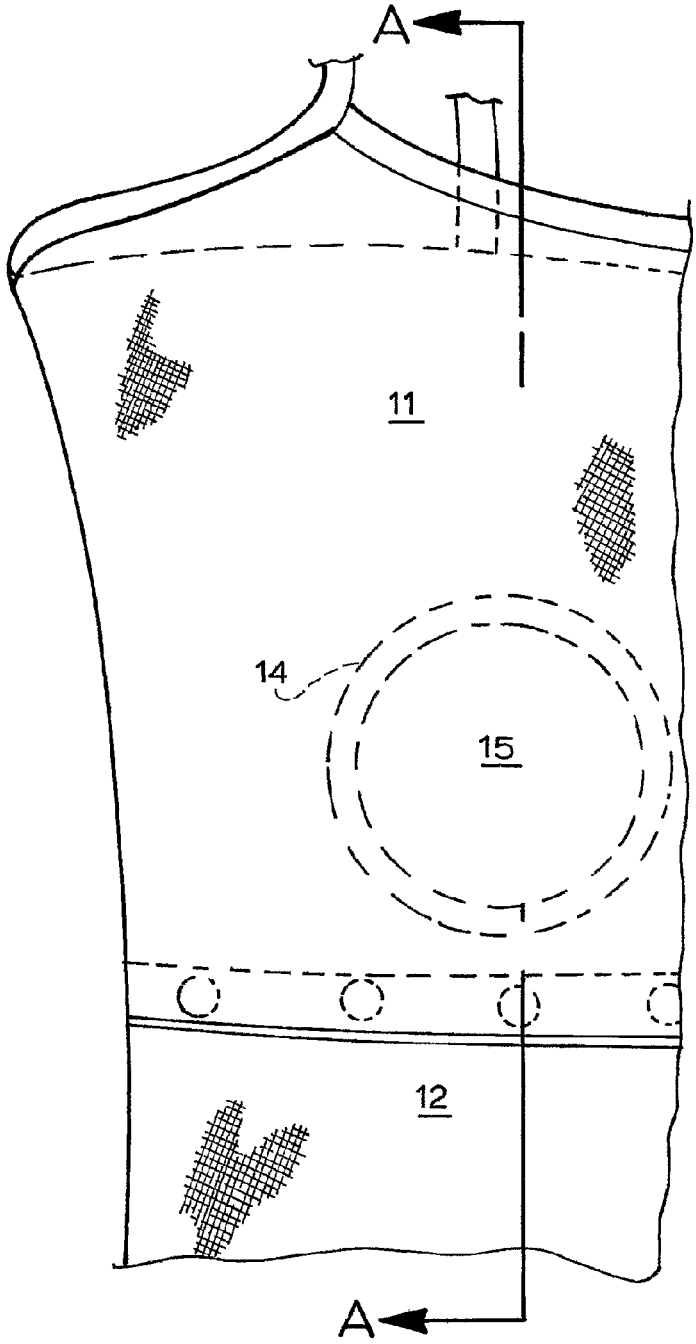

The cross-section view of FIG. 2 shows how upper section 11 of the top overlaps and clips onto lower section 12. It also reveals an annular pocket 14 which holds breast pads 15 securely in place over the nipples. Breast pads 15 can easily be replaced by unclipping the press studs thus allowing easy access to the pocket.

The horizontal seam 13 under the breasts which carries the press studs can be disguised by use of a feature fabric such as lace or piping so that there is no external evidence of the top being a breast feeding garment. The press stud tape used to attach the top section to the lower section of the garment could be replaced with a VELCRO® hook and loop fastener strip, hooks and eyes, magnetic strips, zips, buttons or slide fasteners.

Figure 6:
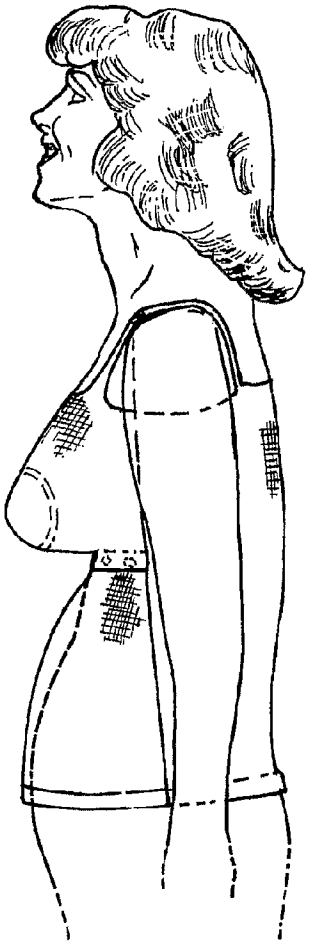
FIG. 6 is a side view of the top shown in FIGS. 1 and 3, being worn.
Figure 5:
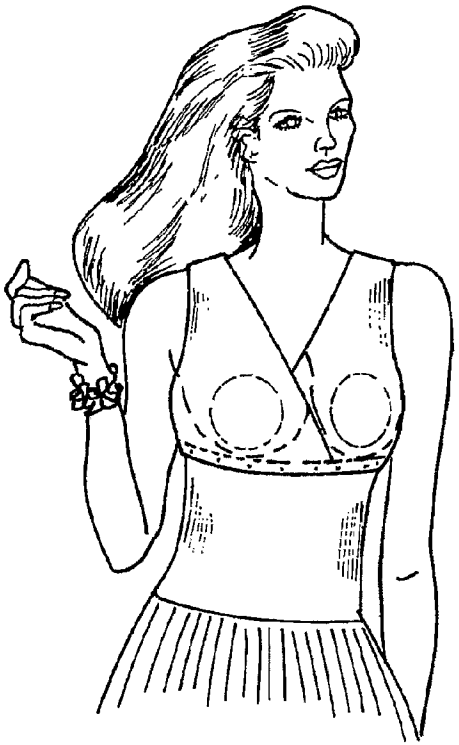
FIG. 5 shows an alternative cross-over top design.

In FIG. 5 an alternative crossover design of tank top incorporating the present invention is shown. This style is particularly attractive as it tends to flatter the enlarged breasts of a nursing mother. FIG. 6 illustrates the ample lower section of the top which attractively accommodates the enlarged stomach of the mother both before and after birth.

The garment can be worn either by itself or underneath an external garment such as a coat. In the latter case the coat does not have to be removed but simply opened to provide access to the breast for the baby.

Accordingly it will be seen that the nursing garment of the present invention does not suffer from the traditional problems of for example, the maternity bra. The latter only serves as an undergarment, is cumbersome to detach from the upper bra strap and provides no cover when the baby is feeding. Similarly the external garments based on the nursing bra design all rely on the bra style fastener and the drop down method which draws attention to the fact that the mother is breast feeding.

The present invention provides a comfortable and breathable garment which is suitable for day wear or sleepwear. It also provides additional support and coverage which is ideal for the later months of pregnancy.

VARIATIONS

It will be realized that while the foregoing has been given by way of illustrative example of this invention all such and other modifications and variations thereto as would be apparent to persons skilled in the art are deemed to fall within the broad scope and ambit of this invention as herein set forth.

Throughout the description and claims of this specification the word comprise and variations of that word such as "comprises" and "comprising" are not intended to exclude other additives components, integers or steps.

The invention claimed is:

1. A nursing garment in the style of a tank top comprising:

a front panel divided into an upper section and a lower section with the upper section attached to the lower section in a single detachable seam extending horizontally across the front of the garment just below the breasts, wherein the upper section overlaps the lower section; and annular pockets on the inside of the upper section adjacent to the breast nipples, which pockets receive replaceable nursing pads.

2. The garment of claim 1 in which the upper section is attached to the lower section by fixing means selected from press studs, hook and loop fasteners, hooks and eyes, magnetic strips, zips, buttons and slide fasteners.

3. The garment of claim 1 in which the lower section provides ample space to accommodate the enlarged stomach of a mother before and after birth.

4. The garment of claim 1 in which the upper section is designed in a crossover style or a V neck style.

5. The garment of claim 2 in which the lower section provides ample space to accommodate the enlarged stomach of a mother before and after birth.

6. The garment of claim 2 in which the upper section is designed in a crossover style or a V neck style.

7. The garment of claim 3 in which the upper section is designed in a crossover style or a V neck style.

8. A nursing garment comprising:

a front panel divided into an upper section and a lower section with the upper section attached to the lower section in a single detachable seam extending horizontally across the front of the garment just below the breasts, wherein the upper section overlaps the lower section, wherein the upper section is designed in a crossover style or a V neck style, and wherein the garment comprises sleeves; and annular pockets on the inside of the upper section adjacent to the breast nipples, which pockets receive replaceable nursing pads.

9. The garment of claim 8 in which the upper section is attached to the lower section by fixing means selected from press studs, hook and loop fasteners, hooks and eyes, magnetic strips, zips, buttons and slide fasteners.

10. The garment of claim 8 in which the lower section provides ample space to accommodate the enlarged stomach of a mother before and after birth.

* * * * *